US006290213B1

(12) United States Patent
Laird et al.

(10) Patent No.: US 6,290,213 B1
(45) Date of Patent: Sep. 18, 2001

(54) MODULAR RAIL ASSEMBLY

(75) Inventors: Ralph H. Laird, New Berlin; Mark A. Brooks, Mukwonago; Robert D'Addario; Kevin L. Noll, both of Milwaukee; Michael R. Thomas, Wauwatosa, all of WI (US)

(73) Assignee: Wildeck Mezzanines, Inc., Waukesha, WI (US)

( * ) Notice: Subject to any disclaimer, the term of this patent is extended or adjusted under 35 U.S.C. 154(b) by 0 days.

(21) Appl. No.: 09/457,973

(22) Filed: Dec. 9, 1999

(51) Int. Cl.[7] ..... E04H 17/14
(52) U.S. Cl. ..... 256/65; 256/69
(58) Field of Search ..... 256/65, 19, 21, 256/22, 66, 67, 68, 69, DIG. 5

(56) References Cited

U.S. PATENT DOCUMENTS

| | | | | |
|---|---|---|---|---|
| 447,231 | * | 2/1891 | Cleaveland | 182/228.6 X |
| 2,117,798 | | 5/1938 | Gascoiqne et al. . | |
| 2,859,990 | | 11/1958 | Derrig . | |
| 3,166,299 | * | 1/1965 | Chellis | 256/65 |
| 3,318,413 | * | 5/1967 | Werner et al. | 182/46 |
| 3,327,385 | * | 6/1967 | Shaver | 29/523 |
| 3,333,823 | * | 8/1967 | Genauer et al. | 256/65 |
| 3,342,457 | | 9/1967 | Bobrowski . | |
| 3,484,827 | * | 12/1969 | Hall | 256/65 X |
| 3,787,033 | | 1/1974 | Snyder et al. . | |
| 3,853,203 | | 12/1974 | Werner et al. . | |
| 4,149,701 | * | 4/1979 | Densen | 256/65 |
| 4,208,038 | * | 6/1980 | Reid | 256/65 X |
| 4,286,372 | | 9/1981 | Batcheller . | |
| 4,351,469 | * | 9/1982 | Newman | 256/65 X |
| 4,466,600 | * | 8/1984 | Tuttle | 256/65 |
| 4,477,059 | * | 10/1984 | Willis | 256/65 |
| 4,493,579 | * | 1/1985 | Rautakoura | 256/65 X |
| 4,656,721 | * | 4/1987 | Werner | 29/523 |
| 4,813,651 | * | 3/1989 | Rutledge | 256/21 X |
| 4,952,092 | * | 8/1990 | Ballerstein | 256/65 X |
| 4,967,879 | * | 11/1990 | Klafs et al. | 182/228 |
| 5,161,783 | * | 11/1992 | German | 256/19 |
| 5,382,111 | * | 1/1995 | Melashenko et al. | 256/65 X |

(List continued on next page.)

FOREIGN PATENT DOCUMENTS

| | | | | |
|---|---|---|---|---|
| 2382566 | * | 11/1978 | (FR) | 256/21 |
| 650253 | | 11/1948 | (GB) . | |
| 742857 | * | 11/1978 | (GB) | 256/65 |
| 2 023 253 A | | 12/1979 | (GB) . | |
| 2238331 | * | 5/1991 | (GB) | 256/65 |

*Primary Examiner*—Lynne H. Browne
*Assistant Examiner*—David E. Bochna
(74) *Attorney, Agent, or Firm*—Michael Best & Friedrich LLP

(57) ABSTRACT

The modular rail assembly of the present invention includes at least one post, at least one rail, and at least one sleeve. The post is mounted to a surface and preferably extends upward. A sleeve is inserted into openings in the post. The openings are on opposite sides of the post. The sleeve preferably has a flange that contacts the post and prevents the sleeve from sliding completely thorough the openings. A rail is slid through the sleeve and preferably extends parallel to the surface. A single rail can extend through several posts. The sleeve acts as a buffer and protects the rail finish from being scratched or damaged by the post. Because of the sleeve, the modular rail assembly can be reassembled in any position without showing scratch marks or unpainted portions of the rail. In the preferred embodiment, a cap covers the top end of the post. There is also an opening in the cap into which a sleeve is inserted. A rail is slid through the sleeve and cap, similar to the rail and the post. The rail through the cap can serve as the top rail for the modular rail assembly. The modular rail assembly provides a portable barrier for raised surfaces. This invention features the stability and appearance of a permanent structure as well as the versatility and mobility of a temporary railing.

20 Claims, 2 Drawing Sheets

U.S. PATENT DOCUMENTS 5,593,143 * 1/1997 Ferrarin ..... 256/68
5,683,074 11/1997 Purvis et al. .
5,713,171 2/1998 Andres .
5,765,812 6/1998 Guenther .
5,857,664 * 1/1999 Schauman ..... 256/19
5,882,001 3/1999 Reinbold .
6,131,886 * 10/2000 Venegas, Jr. ..... 256/66 X
6,142,453 * 11/2000 Martin ..... 256/65

* cited by examiner

MODULAR RAIL ASSEMBLY

FIELD OF THE INVENTION

This invention relates generally to safety barriers, and more particularly to apparatus and methods for constructing modular rail assemblies for decks or raised platforms.

BACKGROUND OF THE INVENTION

There are a wide variety of railings that are used to create safety barriers for balconies or other raised platforms. These railings commonly consist of posts and rails. The railings are typically connected to the posts using welded joints, bolted attachments, or threads. Assembling these connections is difficult and time consuming, and they are not easily altered for different configurations.

Portable railings are railings that can be installed or removed in a short period of time. These railings are often used at construction sites, in commercial buildings, or any other place with an elevated platform. Portable railings must be capable of quick disassembly and reassembly at a different location. A portable railing provides the safety and flexibility to use a raised platform for a variety of purposes.

The most important feature of a portable railing is the connection between the rail and the post. The connection determines the ease with which the railing can be assembled or disassembled. Prior art rail assemblies use conventional connections, such as welded joints, bolts, or threaded connections. These connections are undesirable because of the amount of time and effort required to install or uninstall the rail assembly.

Welding creates a permanent connection that is not easily taken apart. Welded joints also require expensive equipment on site to create them, and a certain level of skill to operate the equipment. Welding may be acceptable for permanent railings, but does not suit the needs of a portable railing.

Bolted and clamped connections require extra tooling such as wrenches or pliers. The greatest limitation of bolt and clamp connections is the bolt holes or the marks left behind after the railing is disassembled. Bolt and clamp connections usually contact the surface of the rail and post and damage the paint or finish at the points of contact. These clamps also require extra clamping parts in addition to the rail and post. These additional parts are easily lost when the railing is disassembled and moved to a different location.

Threaded connections require special couplings for the joints between the rails and the posts. These couplings must be preformed with threads before the railing can be installed. The rails must also be threaded to connect with the couplings and posts. This type of railing can only be installed in predetermined lengths because the rail must end at each post. This limitation greatly reduces the versatility of threaded connection railings. The threads on the rails are also easily damaged when moving the railing, and may not fit back into the coupling when the railing is reinstalled.

In light of the problems and limitations of the prior art described above, a need exists for a modular rail assembly that is versatile, can be quickly assembled or disassembled with minimal use of tools, and can be assembled in a variety of different configurations. Each preferred embodiment of the present invention achieves one or more of these results.

SUMMARY OF THE INVENTION

The modular rail assembly of the present invention includes a post, a rail, a cap, and a low friction sleeve. The post is attached near the surface or stairway the railing is bordering. A sleeve is placed through holes in the post and cap, and the rail is inserted through the sleeve. Set screws in the post and cap are tightened into the sleeves to secure the rail.

In this invention the rail extends through the sleeve and post or sleeve and cap. The post can be placed at different points along the length of the rail. The distance between posts is not dependent on the length of the rail section. Sliding the rail through the sleeve and post creates a stronger, more attractive connection than existing procedures for creating portable rail assembles. This modular rail assembly connecting a rail to a post provides easy installation on site without the need for extra tools or welded joints. The railing is strong and sturdy, yet easy to disassemble and install at a different location. It possesses the versatility and adaptability of a temporary rail assembly with the functionality and appearance of a permanent structure.

The post preferably consists of a tube extending upward and set screws. In the preferred embodiment the post is a square tube that preferably mounts to the floor, stairs, ramp, or adjacent wall structure with bolts. Preferably, the square tube post has circular holes cut on opposite sides directly across from one another. Preferably, the square tube post has circular holes cut on opposite sides directly across from one another. These holes allow a rail and sleeve to be inserted through the post.

A low friction sleeve is utilized to prevent the post from scratching the rail. The sleeve preferably has an inner diameter slightly larger than the diameter of the rail, an outer diameter slightly smaller than the holes in the post, and a length extending at least the width of the post. The inner surface of the plastic sleeve allows the rail to slide through the sleeve, and the outer surface is small enough to slide into the circular holes on the square post. The post preferably has a set screw that is tightened to hold the rail in place. The set screw can apply pressure to the sleeve, which in turn compresses the sleeve around the rail to keep the rail stationary. The set screw and sleeve preferably hold the rail in place without damaging the surface of the rail.

One or more posts are mounted on the edge of the surface to be bordered. When multiple posts are used, the holes on these posts are aligned, and the rail is slid through the plastic sleeves and the holes on the respective posts until the rail extends the length of the surface edge. Because the rail finish is not damaged, the sleeve allows the rail to be inserted through a post in a variety of locations without revealing unpainted or scratched surfaces.

A separate piece is used for the formed cap on the posts. The bottom of the cap preferably has a mating surface that connects to the top end of the post The cap has a through hole that can allow a rail and sleeve to be slid through it. Preferably, there is also a set screw in the cap that holds the rail in place. The set screw in the cap preferably works the same as the set screw in the post by putting pressure on the sleeve, which compresses on the rail. In the preferred embodiment, the rail through the cap serves as the top rail in the railing assembly.

The value of this invention lies in its interchangeability. This handrail assembly can be easily installed on a balcony and then quickly disassembled with no damage and installed somewhere else with no need for repainting. This feature is useful in manufacturing plants, warehouses, or other commercial buildings that use balconies to maximize space and frequently change their layout.

Still other advantages and features of the invention, together with the organization and manner of operation thereof, will become apparent from the following detailed description when taken in conjunction with the accompanying drawings wherein like elements have like numerals throughout the drawings.

BRIEF DESCRIPTION OF THE DRAWINGS

The present invention is further described with reference to the accompanying drawings, which show a preferred embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION

Figure 1:
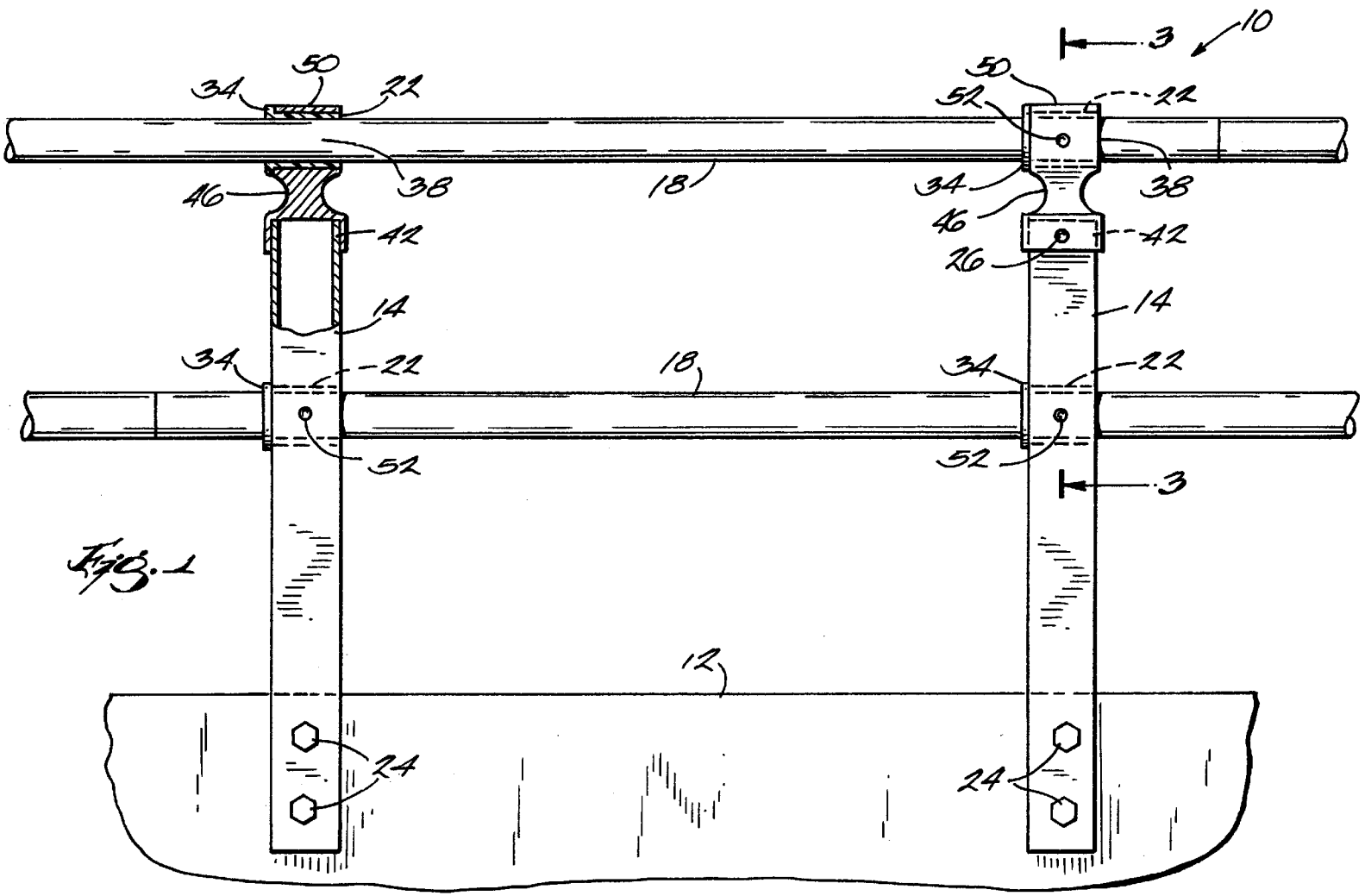
FIG. 1 is a side view of the modular rail assembly embodying the present invention.

The modular rail assembly 10 illustrated in FIG. 1 is installed on a surface 12, such as an elevated platform. The illustrated modular rail assembly 10 includes a series of posts 14, rails 18, and sleeves 22 between the posts 14 and the rails 18. In the illustrated embodiment, each post 14 is mounted to the surface 12 with bolts 24. The specific technique used to mount the post 14 to the surface 12 is not important to the invention. Any conventional means of fastening can be used to serve this function, such as: screws, nails, clamps, dowels, brackets, latches, holes, etc. However, it is desirable to have a mounting means that is easily removable. The surface 12 can be any surface the modular rail assembly 10 is bordering. Examples of surfaces, given for illustrative purposes only, include stairs, ramps, balconies, platforms, lofts, walkways, docks, ledges, etc.

Figure 2:
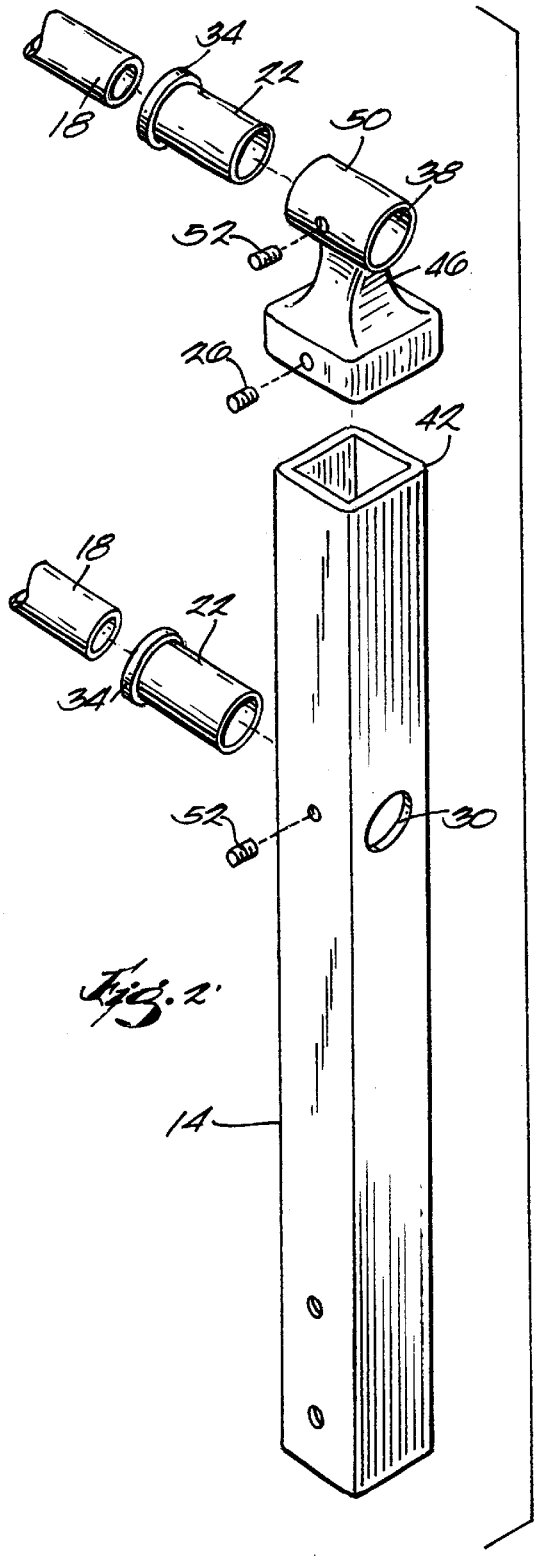
FIG. 2 is an exploded perspective view of the modular rail assembly illustrated in FIG. 1.
Figure 4:
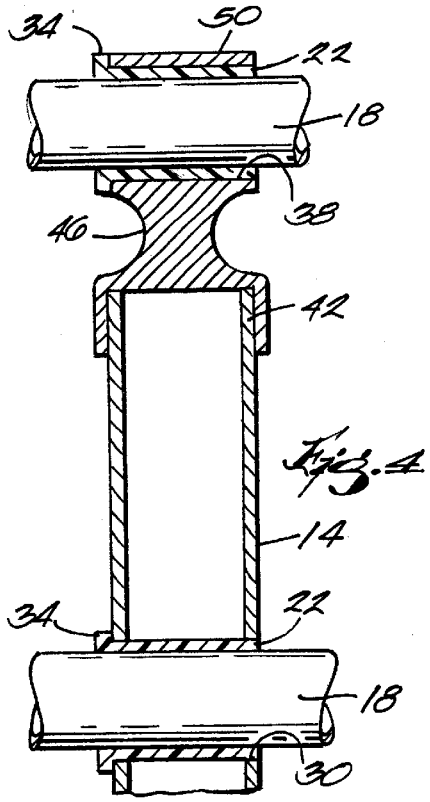
FIG. 4 is a cross-sectional side view taken along line 4—4 in FIG. 3.
Figure 3:
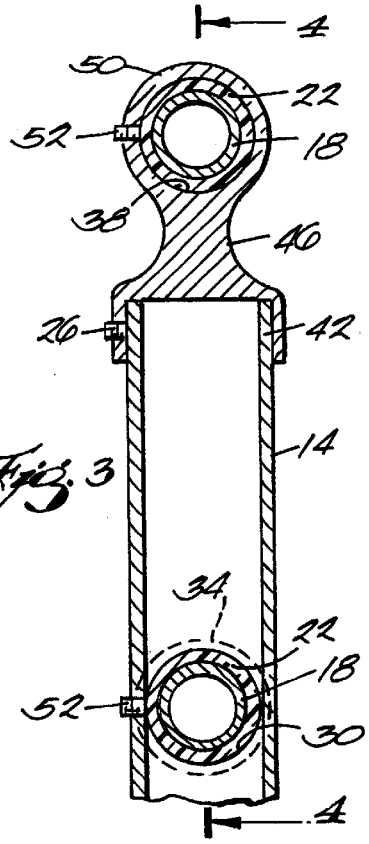
FIG. 3 is a cross-sectional end view take along line 3—3 in FIG. 1.

The posts 14 are elongated members that support the rails 18 above the surface 12. In the preferred embodiment, each post is a hollow quadrangular (e.g., square) tube and stands substantially vertical. In alternate embodiments, the posts 14 could be a solid structure and rounded or multi-sided. The posts 14 could also sit at varying angles to the surface 12. Preferably, the posts 14 are made from metal or some other substantially rigid material. Each post 14 has openings 30 on opposite sides (FIGS. 2–4). The openings 30 are large enough for the sleeves 22 to fit inside. The shape of the openings 30 is preferably similar to the shape of the sleeve 22 and the rail 18.

The rail 18 is an elongated member that extends through the posts 14. Preferably, the rail 18 is substantially parallel to the surface 12 and provides the main barrier element of the modular rail assembly 10. In the preferred embodiment, the rail 18 is circular, but it can be any shape. The rail 18 could also be shaped like an oval, rectangle, or any other appropriate shape. The only requirement is that the rail 18 can fit through the sleeve 22 and the post openings 30.

The figures illustrate the preferred embodiment with two rails 18. This number is not required, and other numbers of rails 18 could be used depending on the application. A single rail 18 could also be used if desired. The rail 18 is preferably made from metal, or any other substantially rigid material.

The modular rail assembly 10 can also include a cap 50. The purpose of the cap 50 is partly aesthetic and partly functional. The top end 42 of the post 14 is usually open, and the cap 50 covers that opening. The preferred embodiment uses the cap 50 to support the top rail 18, but other embodiments may use a cap 50 without an opening 38. Preferably, the cap 50 rests on the top end 42 of the post 14 and has a set screw 26 that tightens against the post 14. The cap 50 preferably has a tapered middle section 46 and a tubular opening 38. Other embodiments of the cap could be straight or even bulge out near the middle section. The tapered middle section 46 is mainly for decorative purposes. The opening 38 is large enough for a sleeve 22 to fit inside. The shape of the opening 38 is preferably similar to the shape of the sleeve 22 and rail 18.

The sleeves 22 fit inside the post openings 30 and the cap openings 50 and primarily protect the rail 18 from damage. Preferably, the sleeves 22 are hollow and tubular and have a flange 34 on one end. The flange 34 holds the sleeve 22 in place while the rail 18 is slid through the sleeve 22. The interior shape of the sleeve 22 preferably matches the shape of the rail 18, and the exterior shape of the sleeve 22 preferably matches the shape of the post openings 30 and cap openings 38. The sleeves 22 are preferably made from a low friction material, such as plastic, nylon, or a similar material that is softer than the material used for the rail 18.

In the illustrated embodiment, the post 14 and cap 50 have set screws 52 to secure the sleeves 22 and rails 18. When tightened, the set screw 52 can apply a force on the sleeve 22, which then compresses on the rail 18. The force applied by the set screw 52 holds the rail 18 secure in the post 14 or cap 50. The set screws 52 are preferably recessed screws that are tightened with a screw driver. In other embodiments, the set screws 52 could be bolts with hex heads, wing heads, or any other tightening means known to one skilled in the art. Alternatively, the set screws could be omitted, thereby allowing the rails 18 to slide within the sleeves 22.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A modular rail assembly and a surface comprising:

a post having a post opening, wherein the post is secured to the surface;

a sleeve positioned in the post opening, the sleeve including a sleeve opening, wherein the sleeve comprises a material that is softer than the rail; and a rail positioned in the sleeve opening, wherein the rail extends completely through the sleeve and the post.

2. A modular rail assembly as claimed in claim 1, wherein the post is a quadrangular tube.

3. A modular rail assembly as claimed in claim 1, wherein the post opening is circular.

4. A modular rail assembly as claimed in claim 1, wherein the rail is substantially perpendicular to the post.

5. A modular rail assembly as claimed in claim 1, wherein the rail is a circular tube.

6. A modular rail assembly as claimed in claim 1, further comprising a set screw securing the rail in the sleeve opening.

7. A modular rail assembly as claimed in claim 1, wherein the sleeve includes a flange on one end, the flange being larger than the post opening.

8. A modular rail assembly as claimed in claim 1, wherein the sleeve comprises a material that is softer than the rail.

9. A modular rail assembly and a surface comprising:

a post member having a top end, wherein the post is secured to the surface;

a cap positioned over the top end of the post, the cap having a cap opening;

a sleeve positioned in the cap opening, the sleeve including a sleeve opening, wherein the sleeve comprises a material that is softer than the rail; and a rail positioned in the sleeve opening, wherein the rail extends completely through the sleeve and the cap.

10. A modular rail assembly as claimed in claim 9, wherein the cap includes:

a bottom surface positioned on the top end of the post;

a tapered middle section; and a rounded tubular top portion having the cap opening.

11. A modular rail assembly as claimed in claim 9, wherein the rail is a circular tube.

12. A modular rail assembly as claimed in claim 9, wherein the post is a quadrangular tube.

13. A modular rail assembly as claimed in claim 9, further comprising a set screw securing the rail in the sleeve opening.

14. A modular rail assembly as claimed in claim 9, wherein the sleeve includes a flange on one end, the flange being larger than the cap opening.

15. A modular rail assembly as claimed in claim 9, wherein the sleeve comprises a material that is softer than the rail.

16. A method of constructing a modular rail assembly using a post, a rail, and a sleeve comprising a material that is soften than the rail, comprising the steps of:

forming a post opening in the post;

mounting the post to a surface;

placing the sleeve into the post opening;

forming a sleeve opening in the sleeve; and inserting the rail completely through the sleeve and the post.

17. The method as claimed in claim 16, further comprising the step of tightening a set screw in the post to apply pressure on the rail.

18. A method as claimed in claim 16, further comprising the steps of:

positioning a cap with a cap hole on the top of the post;

placing a sleeve into the cap hole; and inserting a rail completely through the sleeve.

19. A method as claimed in claim 18, further comprising the step of tightening a set screw in the cap to apply pressure on the post.

20. A method as claimed in claim 18, further comprising the step of tightening a set screw in the cap to apply pressure on the rail that is positioned in the cap.

* * * * *